US006557833B1

(12) United States Patent
Roth

(10) Patent No.: US 6,557,833 B1
(45) Date of Patent: May 6, 2003

(54) PRIMING SYSTEM FOR AN ENGINE CARBURETOR

(75) Inventor: David Roth, Fond du Lac, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 09/693,576

(22) Filed: Oct. 20, 2000

(51) Int. Cl.[7] ..... F02M 1/16

(52) U.S. Cl. ..... 261/34.1; 261/DIG. 8; 123/179.11

(58) Field of Search ..... 261/34.1, 35, DIG. 8, 261/DIG. 67, DIG. 73; 123/179.11

(56) References Cited

U.S. PATENT DOCUMENTS

| | | | | | |
|---|---|---|---|---|---|
| 3,281,129 | A | * | 10/1966 | Payne | 261/DIG. 8 |
| 3,307,836 | A | | 3/1967 | Arndt et al. | 261/34 |
| 3,371,658 | A | * | 3/1968 | Turner | 261/DIG. 8 |
| 3,430,933 | A | * | 3/1969 | Taggart | 261/DIG. 8 |
| 3,706,444 | A | | 12/1972 | Masaki et al. | 261/39 D |
| 3,780,996 | A | * | 12/1973 | Nutten | 261/DIG. 8 |
| 4,203,405 | A | | 5/1980 | Schultz et al. | 261/DIG. 8 |
| 4,323,522 | A | | 4/1982 | Rasmussen | 261/DIG. 8 |
| 4,375,795 | A | | 3/1983 | Billingsley | 261/DIG. 8 |
| 4,411,844 | A | | 10/1983 | Morris et al. | 261/DIG. 8 |
| 4,437,448 | A | | 3/1984 | Billingsley | 123/577 |
| 4,499,032 | A | | 2/1985 | Shibano | 261/DIG. 67 |
| 4,499,887 | A | | 2/1985 | Billingsley et al. | 123/575 |
| 4,679,534 | A | | 7/1987 | Guntly et al. | 261/DIG. 8 |
| 4,684,484 | A | | 8/1987 | Guntly | 261/35 |
| 4,684,485 | A | * | 8/1987 | Scott | 261/DIG. 8 |
| 4,694,792 | A | | 9/1987 | Uuskallio | 123/187.5 R |
| 4,735,751 | A | | 4/1988 | Guntly | 261/35 |
| 4,738,232 | A | | 4/1988 | Scott | 261/64.6 X |
| 4,793,951 | A | * | 12/1988 | Scott | 261/DIG. 8 |
| 4,848,290 | A | | 7/1989 | Miller | 123/524 X |
| 4,905,641 | A | | 3/1990 | Miller | 123/516 X |
| 4,926,808 | A | | 5/1990 | Kandler | 261/72.1 X |
| 5,070,829 | A | | 12/1991 | Guntly et al. | 123/179.9 |
| 5,128,071 | A | | 7/1992 | Smith et al. | 261/34.2 |
| 5,273,008 | A | | 12/1993 | Ditter | 261/72.1 X |
| 5,740,781 | A | | 4/1998 | Scott et al. | 123/437 |
| 5,803,035 | A | | 9/1998 | Guntly | 123/179.11 |
| 5,891,369 | A | * | 4/1999 | Tuggle et al. | 261/35 |
| 6,029,619 | A | | 2/2000 | Mitchell | 123/179.11 |

FOREIGN PATENT DOCUMENTS

| | | | | |
|---|---|---|---|---|
| JP | 59-194067 | * | 11/1984 | 261/DIG. 8 |
| JP | 64-63640 | * | 3/1989 | 261/DIG. 8 |
| JP | 1-177443 | * | 7/1989 | 261/DIG. 8 |
| JP | 1-178757 | * | 7/1989 | 261/DIG. 8 |
| JP | 1-200051 | * | 8/1989 | 261/DIG. 8 |
| JP | 02078763 | | 3/1990 | |
| JP | 2001164994 | | 6/2001 | |
| WO | WO 99/35389 | | 7/1999 | |

* cited by examiner

*Primary Examiner*—Richard L. Chiesa
(74) *Attorney, Agent, or Firm*—Michael Best & Friedrich LLP

(57) ABSTRACT

A priming system for an engine carburetor. The priming system includes a passageway having a first end in fluid flow communication with a variable volume chamber of a primer bulb and a second end in fluid flow communication with a fuel well. The second end of the passageway opens into the fuel well below a static priming fuel level which is in said fuel well and which at least partially extends into said passageway.

9 Claims, 6 Drawing Sheets

PRIMING SYSTEM FOR AN ENGINE CARBURETOR

FIELD OF THE INVENTION

The present invention generally relates to the field of carburetors for internal combustion engines and, more particularly, to carburetors that utilize priming systems to aid in engine starting.

BACKGROUND OF THE INVENTION

Internal combustion engines are used in a variety of applications, such as for outdoor power equipment which includes, for example, lawn mowers and other lawn and garden equipment, snow blowers, generators, pumps, and the like. Such engines generally include a carburetor wherein fuel received from a fuel source is mixed with air and supplied to a combustion chamber for ignition. To aid in starting such engines, it is generally desirable to provide fuel directly into the carburetor throat prior to engine start-up. This may be accomplished through the use of many different known priming systems.

One such type of priming system includes a primer bulb which, when depressed, displaces a volume of air above the fuel level in a fuel well, wherein the pressurized air urges fuel from the fuel well through a fuel nozzle and into an intake passageway or throat of the carburetor where the fuel is mixed with air and then drawn into the intake manifold of the engine to aid in engine start-up.

A common problem associated with priming systems using a fuel well is that after a priming operation, fuel is typically only slowly replaced in the fuel well. Therefore, if the operator attempts to prime the engine several times in rapid succession, no fuel or not enough fuel is present in the fuel well after the first priming operation, so that the only effective priming operation is the first such operation.

Another common problem associated with priming systems using a fuel well is that each priming charge is limited to the volume of the fuel well, which is typically quite small compared to the fuel bowl where the operating fuel is located, and often not sufficient to efficiently aid in engine start-up.

Another common problem associated with priming systems using a fuel well is that a portion of the pressurized air used to urge fuel from the fuel well through a fuel nozzle and into an intake passageway or throat of the carburetor may escape through an internal venting passageway, thereby decreasing the effectiveness of the priming system. Thus, in order to reduce the loss of the pressurized air, it is known to provide the opening of the venting passageway with a small diameter. A drawback of this type of arrangement is that it is difficult to calibrate the carburetor because of the vacuum created on account of the small diameter vent.

Another common problem associated with priming systems using a fuel well relates to the widely accepted principle that for those carburetors that utilize a fuel metering orifice to regulate the passage of fuel from the fuel bowl to the fuel well, the internal vent for the fuel well must be proportionately sized to the fuel metering orifice to achieve acceptable calibration results. It is desirable to make the fuel metering orifice as large as possible to enhance priming operations by delivering as much fuel as possible to the carburetor throat so that during starting, heavy load conditions and acceleration, a sufficient amount of fuel is delivered to the intake passageway of the carburetor, to ensure efficient starting and continuous, smooth operation of the engine. However, providing a large fuel metering orifice generally results in also providing a large fuel well vent and, as previously noted, a large fuel well vent generally results in a significant portion of the displaced pressurized air escaping through the fuel well vent during priming. Although restricted fuel jetting solves the problem of having a large fuel well vent, restricted fuel jetting detrimentally affects engine efficiency in terms of engine starting and engine operating performance.

SUMMARY OF THE INVENTION

The present invention overcomes the above-noted problems and other problems of the prior art and includes the above-noted features and other features by providing a carburetor for use with an internal combustion engine, wherein a passageway extends between a variable volume chamber of a primer bulb and a fuel well. The passageway is separate and distinct from the fuel well. The passageway is situated such that the outlet of the passageway into the fuel well is below the priming fuel level which at least partially extends into the passageway. The displacement of a volume of air from the primer bulb through the passageway and into the fuel well results in a squirting of a quantity of fuel into a fuel nozzle of the carburetor to provide a priming charge to the carburetor intake passageway. Because the outlet of the passageway into the fuel well is below the priming fuel level, no significant portion of the displaced pressurized air can be lost through a venting aperture. Thus, the size of a fuel metering orifice used to regulate the passage of fuel from a fuel bowl to the fuel well is not limited by an acceptable size for a venting aperture or passageway, as is the case in known prior priming systems. Therefore, the size of the fuel metering orifice can be advantageously increased for improved priming responsiveness and to also better handle heavy loads and acceleration, without concern for the resulting proportionately sized fuel well vent.

Accordingly, the present invention provides a priming system for an engine carburetor that improves the starting efficiency of the engine, enhances calibration consistency, and improves performance characteristics of the engine during operation.

Other features and advantages of the invention will become apparent to those skilled in the art upon review of the following detailed description, claims and drawings in which like numerals are used to designate like features.

Figure 1:
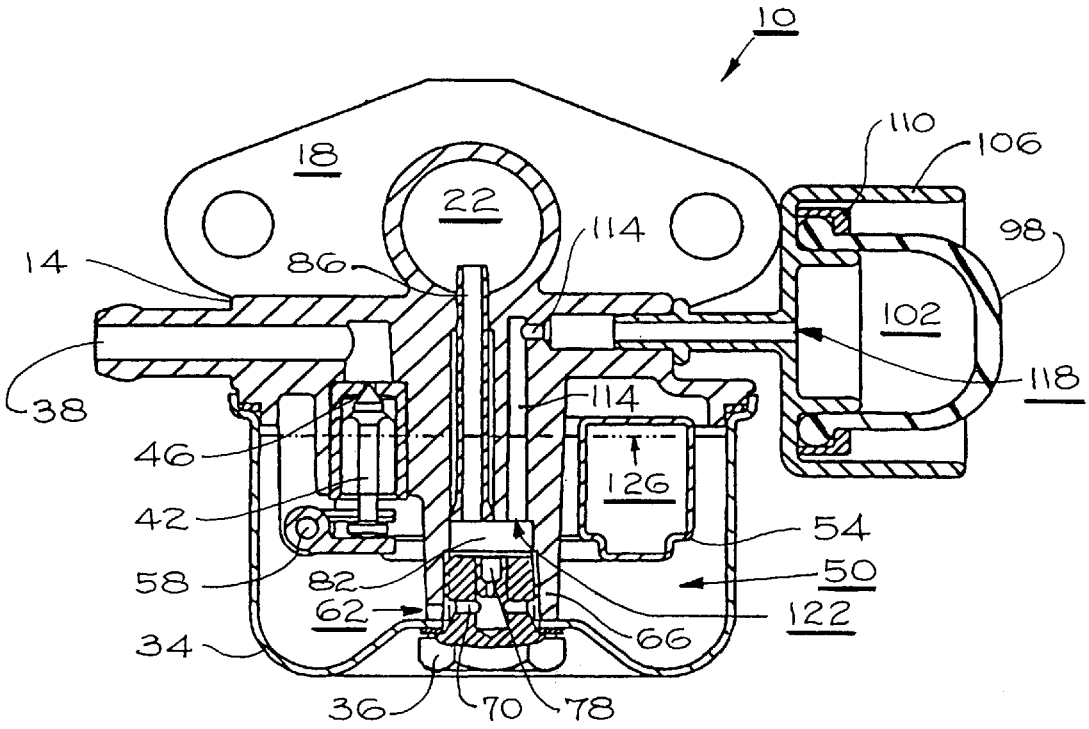
FIG. 1 is a sectional view of one example of a carburetor assembly including the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" herein is meant to encompass only the items listed thereafter and the equivalents thereof.

DETAILED DESCRIPTION OF THE PREFERRED EMBODIMENTS

FIGS. 1–9 depict a number of alternative carburetor assemblies embodying the present invention. Each of the illustrated carburetors are generally of the type that provide a combustible air/fuel mixture to a conventionally aspirated internal combustion engine, such as those commonly used in outdoor power equipment and the like. The overall construction and operation of such carburetors and engines are not shown and will not be described in great detail because internal combustion engines and carburetors therefor are well-known in the art. It should, however, be understood that the present invention is capable of use in other carburetors for use with similar or other internal combustion engines, and the carburetors shown in FIGS. 1–9 are merely shown and described as exemplary models in which the present invention can be employed.

FIG. 1 illustrates carburetor assembly 10. Carburetor body 14 is mounted to an engine (not shown) through the use of flange 18. A fuel or float bowl 34 is secured to the bottom of the carburetor body 14 by bowl nut 36. A carburetor intake passageway or throat 22, that includes a venturi, extends from a carburetor air inlet 26 (see, e.g., FIG. 7) to a carburetor air/fuel outlet 30 (see, e.g., FIG. 7). Fuel is supplied to the carburetor by fuel line 38 from a fuel supply tank (not shown) and passes by way of float valve 42 and valve seat 46 into fuel supply chamber 50 of the fuel bowl 34. Float mechanism 54 disposed within the fuel supply chamber 50 controls the float valve 42 and, therefore, the fuel level within the fuel bowl 34 or fuel supply chamber 50. If the fuel level within the fuel supply chamber 50 is inadequate, float 54 is pivoted downwardly about pivot hinge pin 58 to create a gap between the valve 42 and valve seat 46, so that fuel can flow by gravity from fuel line 38 into the fuel supply chamber 50. Once a proper amount of fuel is delivered to the fuel supply chamber 50, the float 54 is pivoted upwardly about the pivot hinge pin 58 to shut off further fuel flow to the fuel supply chamber 50.

Fuel passes from the fuel supply chamber 50 of the regulated fuel bowl 34 through one or more apertures 62 found in the hollow columnar portion 66 of the carburetor body 14 and into one or more fill orifices or cavities 70 disposed within the bowl nut 36. A fuel metering orifice or main fuel jet 78, also disposed within the bowl nut 36, restricts or regulates the flow of fuel from the fuel supply chamber 50 to a fuel well 82. As used herein, the term "fuel well" refers to a chamber that holds the priming fuel, the chamber including the space between the fuel nozzle and the carburetor body and/or the space between the outlet of the fuel jet and the inlet of the fuel nozzle.

A fuel nozzle 86 operatively interconnects the fuel well 82 and the fuel supply chamber 50 with the carburetor intake passageway 22 to provide fuel to the carburetor intake passageway 22. A throttle valve 90 (see, e.g., FIG. 7) is positioned within the carburetor intake passageway 22 to control the flow rate of the air/fuel mixture through the carburetor intake passageway 22. An air filter 92 (see, e.g., FIG. 7) is interconnected with the carburetor air inlet 26 to filter the air entering the carburetor intake passageway 22.

During normal engine operation, air flows past the top of the fuel nozzle 86. As is generally known, a proper fuel flow rate is facilitated by a pressure differential within the carburetor which allows fuel to flow upwardly through the fuel nozzle 86 and into the intake passageway 22 where the fuel is mixed with air passing therethrough to provide the air/fuel mixture to the engine for starting and for operation. As is generally understood, during initial start-up of the engine, the air flow and, therefore, the pressure differential within the carburetor, is reduced. As a result, a sufficient charge of fuel for starting may not be present. Moreover, it is generally known that more priming fuel is needed when the engine is cold or when the engine has not been used for an extended period of time. According to one aspect of the present invention, the priming system is intended to rectify these problems by providing a priming charge to aid in engine start-up.

Referring again to FIG. 1, a primer bulb 98 having a variable volume chamber 102 is operatively interconnected with the fuel well 82 to allow the carburetor 10 to be primed before the engine is started. The primer bulb 98 is made from a flexible, air impervious, gasoline-resistant, rubber-like material. As will be further explained below, pushing of the primer bulb 98 causes a quantity of fuel to be squirted up through the fuel nozzle 86 and into the carburetor intake passageway 22, to thereby prime the carburetor 10 to aid in engine start-up.

As shown in FIG. 1, primer bulb 98 is sealingly secured to housing member 106 by a primer bulb retainer mechanism 110. The housing member 106 is press fitted into the carburetor body 14 as shown. A passageway 114, which extends at least partially through the carburetor body 14, has a first end 118 which is in fluid flow communication with the variable volume chamber 102 and a second end 122 which opens into and is in fluid flow communication with the fuel well 82.

An important feature of the present invention is that the outlet or second end 122 of the passageway 114 opens into the fuel well 82 below the static or non-operating priming fuel level which is illustratively shown as dotted line 126. The passageway 114 allows air to travel from the variable volume chamber 102 when the primer bulb 98 is depressed, out of the second end 122 of the passageway 114 and into the fuel well 82, thereby squirting a quantity of fuel through the end of the fuel nozzle 86 adjacent the fuel well 82 to provide the appropriate priming charge to the carburetor intake passageway 22.

Figure 7:
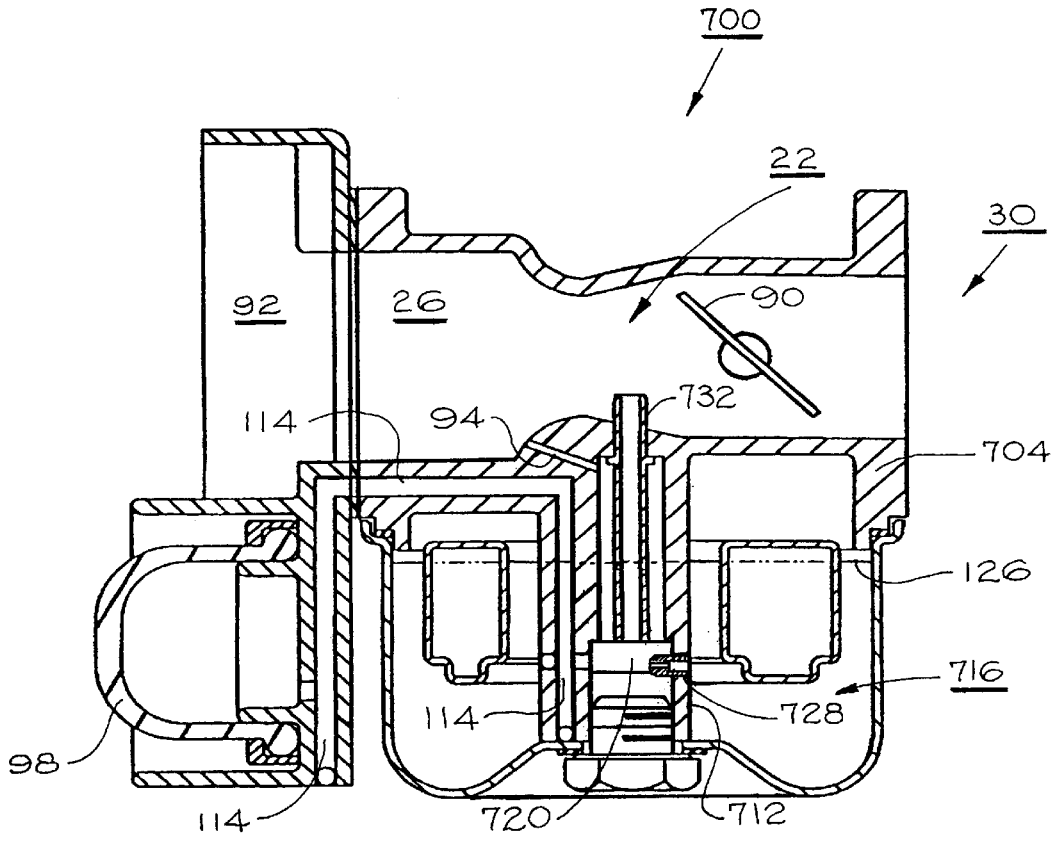
FIG. 7 is a sectional view of another example of a carburetor assembly including the present invention.

A significant advantage of the priming system of the present invention is that since the end 122 of the passageway 114 opens into the fuel well 82 below the starting priming fuel level 126, rather than into the airspace above the starting priming fuel level in a fuel well as is the case in prior known priming systems, no significant portion of the displaced pressurized air will escape through a fuel well venting aperture, such as well vent 94 illustratively shown in FIG. 7. The displaced air travels through the passageway 114, out of the outlet end 122, into the fuel well 82 and into the priming fuel and, as a result, the displaced air has no significant means of escape. Since no significant portion of the pressurized air will escape through a well vent, increasing the size of a well vent, such as well vent 94 as shown in FIG. 7, for optimum engine design will not result in undesirable pressure bleed-off from the fuel well 82 during priming operations. Thus, according to the principles of the present invention, the fuel metering orifice 78 can be sized for optimum calibration and performance characteristics.

Although it is recognized that a small quantity of fuel may be drawn into the variable volume chamber 102 when the primer bulb 98 returns to its non-priming or initial position, this will not adversely affect the overall operation of the priming system of the present invention, nor will the fuel damage the primer bulb 98 due to the type of material from which the primer bulb 98 is made. In fact, according to the present invention, having fuel in the passageway 114 will actually enhance the starting efficiency of the engine. Fuel in the passageway 114 will increase the volume of the fuel priming charge, thereby permitting larger shots of priming fuel with each depression of the primer bulb 98 to potentially increase the starting efficiency of the engine.

Preferably, the end 122 of the passageway 114 is located near the lower end of the fuel nozzle 86 so that when the primer bulb 98 is depressed, a desirable amount of fuel will be squirted into the fuel nozzle 86 to enhance the priming system of the present invention. However, so long as the end 122 of the passageway 114 opens into the fuel well 82 below the static priming fuel level 126, the end 122 of the passageway 114 can be positioned in various other locations and still function according to the principles of the present invention.

As noted, FIGS. 2–9 illustrate various other alternative carburetor assemblies in which the present invention can be employed. Many of the structural and operational characteristics of the carburetor assembly 10 shown and described with respect to FIG. 1 can be found in the carburetor assemblies of FIGS. 2–9. Thus, for the sake of clarity, description of certain structural and operational characteristics is not repeated.

Figure 2:
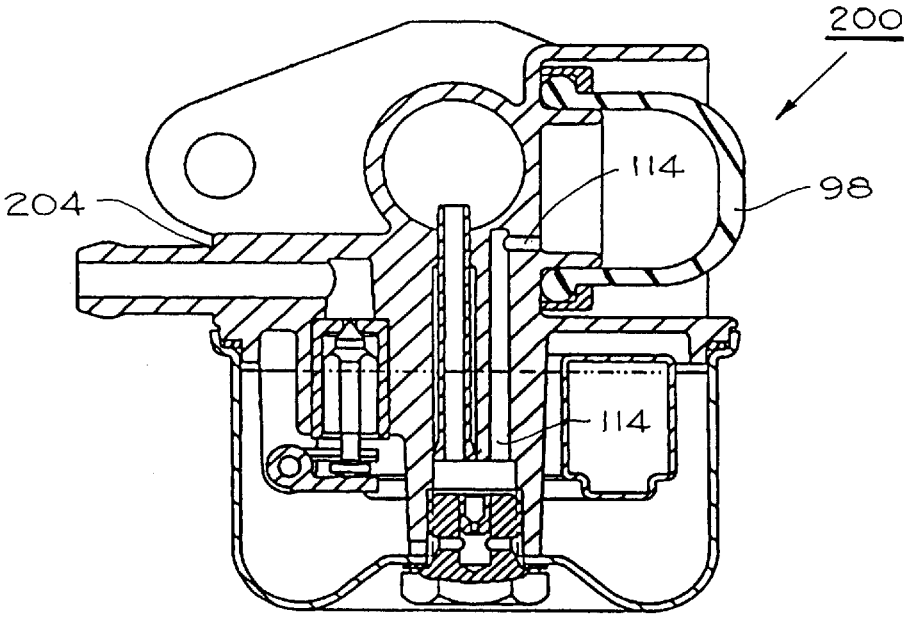
FIG. 2 is a sectional view of another example of a carburetor assembly including the present invention.

FIG. 2 illustrates a second carburetor assembly 200, which is similar to carburetor assembly 10. However, primer bulb 98 is sealingly secured directly to carburetor body 204 and the path of passageway 114 has been slightly altered.

Figure 3:
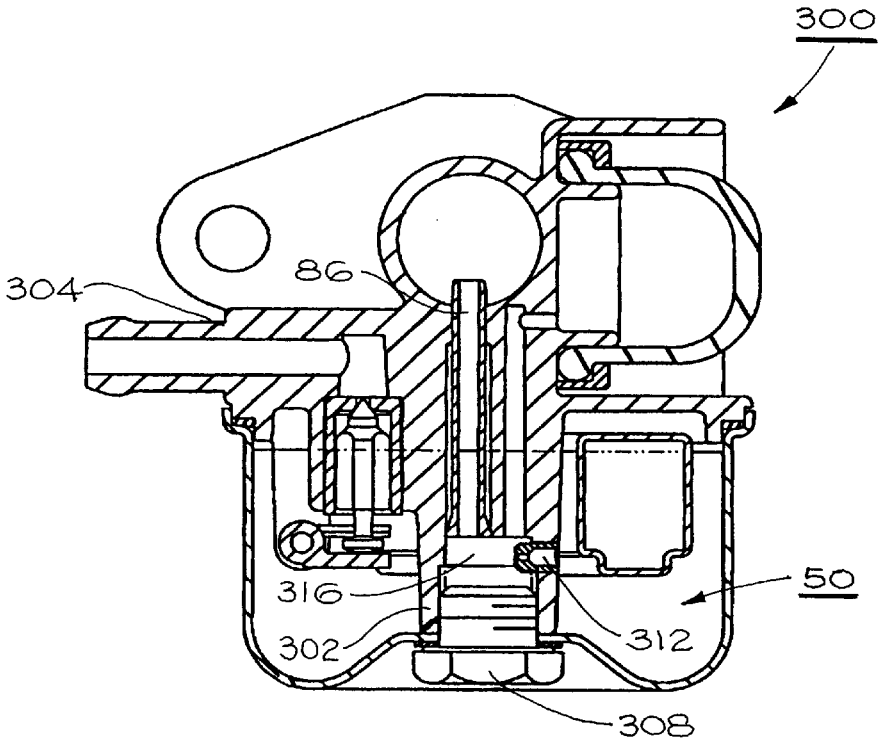
FIG. 3 is a sectional view of another example of a carburetor assembly including the present invention.

FIG. 3 illustrates a third carburetor assembly 300 which is similar to carburetor assembly 200. However, the hollow columnar portion 302 of carburetor body 304 does not include the aperture(s) 62 (FIG. 1), and the bowl nut 308 does not include the fuel metering orifice 78 (FIG. 1) and the fill orifice(s) and cavities 70 (FIG. 1). Rather, a fuel metering orifice 312 is positioned through the columnar portion 302 to extend between the fuel supply chamber 50 and fuel well 316. As shown, fuel metering orifice 312 is placed substantially normal to the fuel nozzle 86, whereas previously the fuel metering orifice 78 (FIG. 1) was shown as being parallel to the fuel nozzle 86 (FIG. 1) and co-axial with the bowl nut 36 (FIG. 1).

Figure 4:
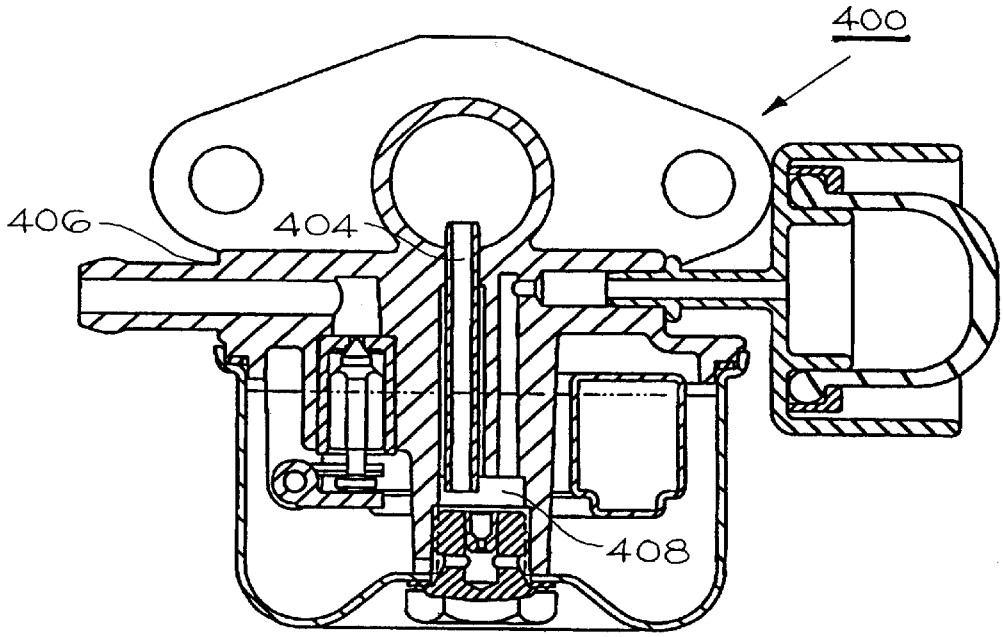
FIG. 4 is a sectional view of another example of a carburetor assembly including the present invention.

FIG. 4 illustrates a fourth carburetor assembly 400 which is similar to carburetor assembly 10. However, in this assembly, in order to provide slightly different calibration requirements, fuel well 408 is an open well as compared to a closed well configuration as shown in FIG. 1. The bottom of the fuel nozzle 404 is not sealed against the carburetor body 406. It should be noted that the priming system of the present invention is capable of use in either closed or open welled carburetors, both of which are commonly known to those skilled in the art. A "closed" fuel well is sealed at the bottom of the nozzle against the carburetor body. An "open" fuel well is not sealed against the carburetor body at the bottom of the nozzle. The illustrated carburetors may be configured as either closed or open welled carburetors as desired.

Figure 5:
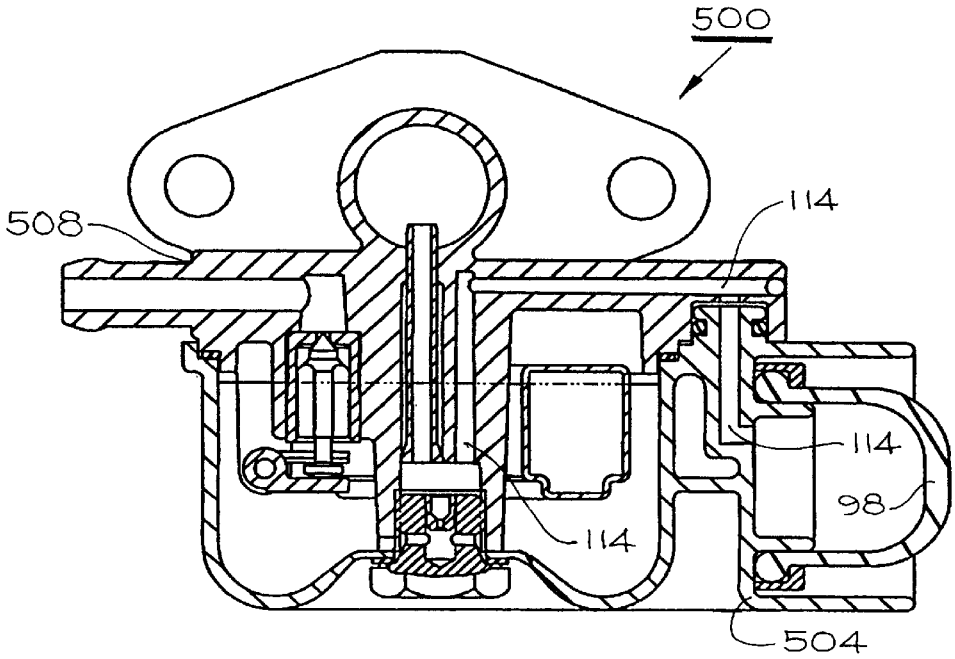
FIG. 5 is a sectional view of another example of a carburetor assembly including the present invention.

FIG. 5 illustrates a fifth carburetor assembly 500 which is similar to carburetor assembly 10. However, primer bulb 98 is sealingly secured to fuel bowl 504, and the path of the passageway 114 has been slightly altered to extend at least partially through the fuel bowl 504 and at least partially through the carburetor body 508.

Figure 6:
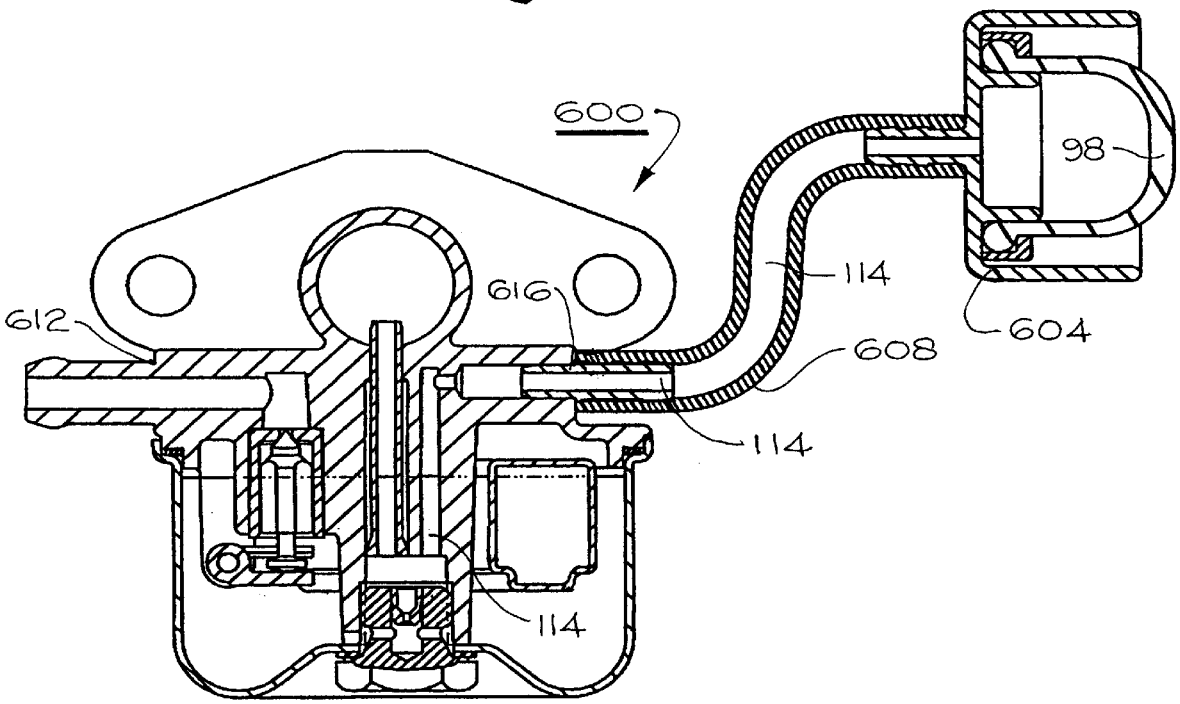
FIG. 6 is a sectional view of another example of a carburetor assembly including the present invention.

FIG. 6 illustrates a sixth carburetor assembly 600 which is similar to carburetor assembly 10. However, primer bulb 98 is sealingly secured to housing member 604 which is sealingly secured to a flexible tube 608, which is sealingly secured to carburetor body 612, and the passageway 114 has been lengthened to extend through the flexible tube 608. A fitting member 616 is used to secure the flexible tube 608 to the carburetor body 612 as shown.

FIG. 7 illustrates a seventh carburetor assembly 700. Primer bulb 98 is sealingly secured to air cleaner housing 92. A fuel metering orifice 728 is positioned through the columnar portion 712 to extend between fuel supply chamber 716 and fuel well 720. The fuel orifice 728 is substantially normal to fuel nozzle 732. The passageway 114 extends at least partially through the carburetor body 704 and opens into well 720 below the priming fuel level 126.

Figure 8:
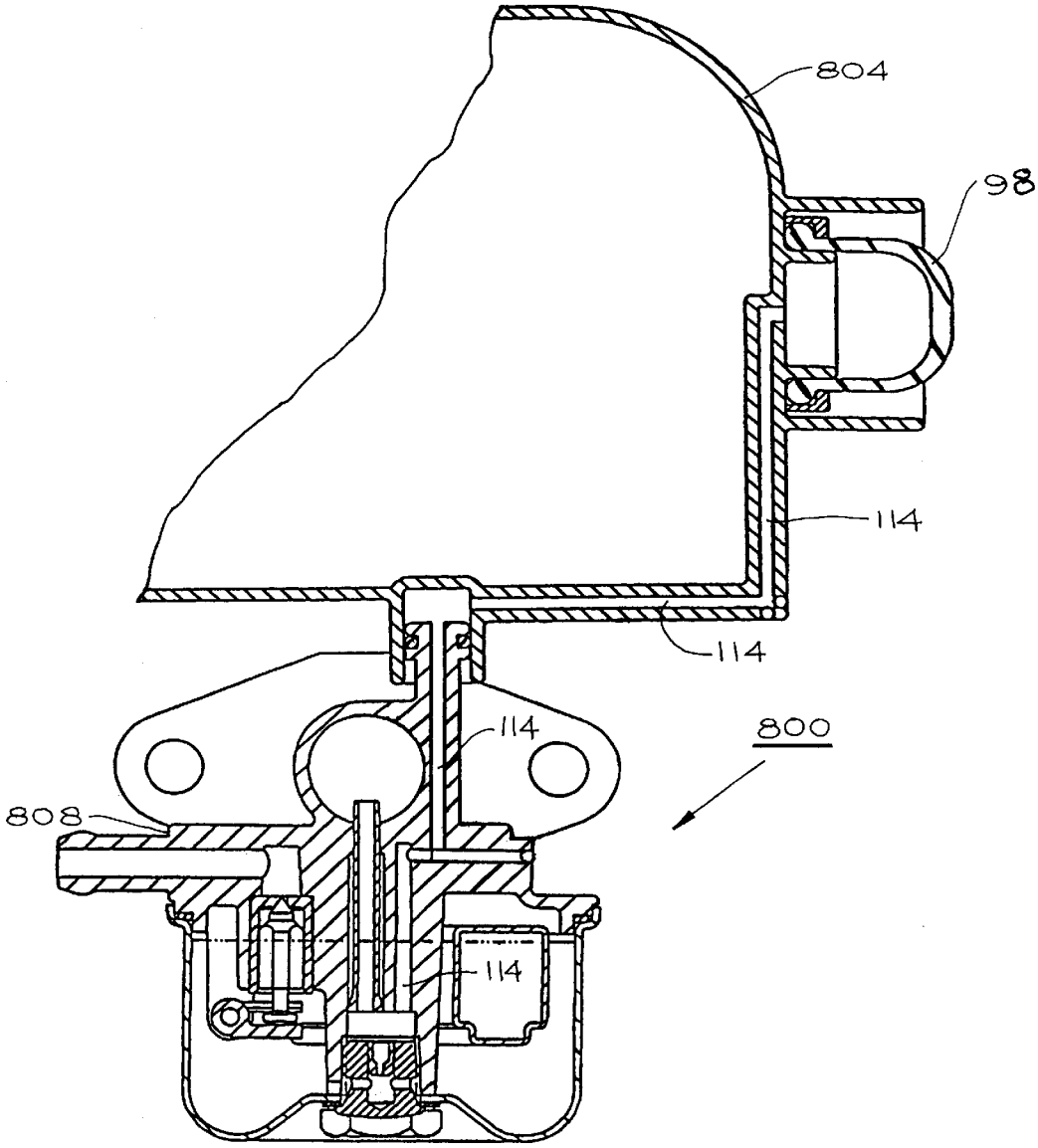
FIG. 8 is a sectional view of another example of a carburetor assembly including the present invention.

FIG. 8 illustrates an eighth carburetor assembly 800 which is similar to carburetor assembly 200. However, primer bulb 98 is sealingly secured to an air filter housing or fuel tank 804 which is sealingly secured to carburetor body 808, and the path of the passageway 114 has been lengthened to accommodate the remote location of the primer bulb 98. Preferably, at least a portion of path 114 is integral with the air filter housing or fuel tank 804.

Figure 9:
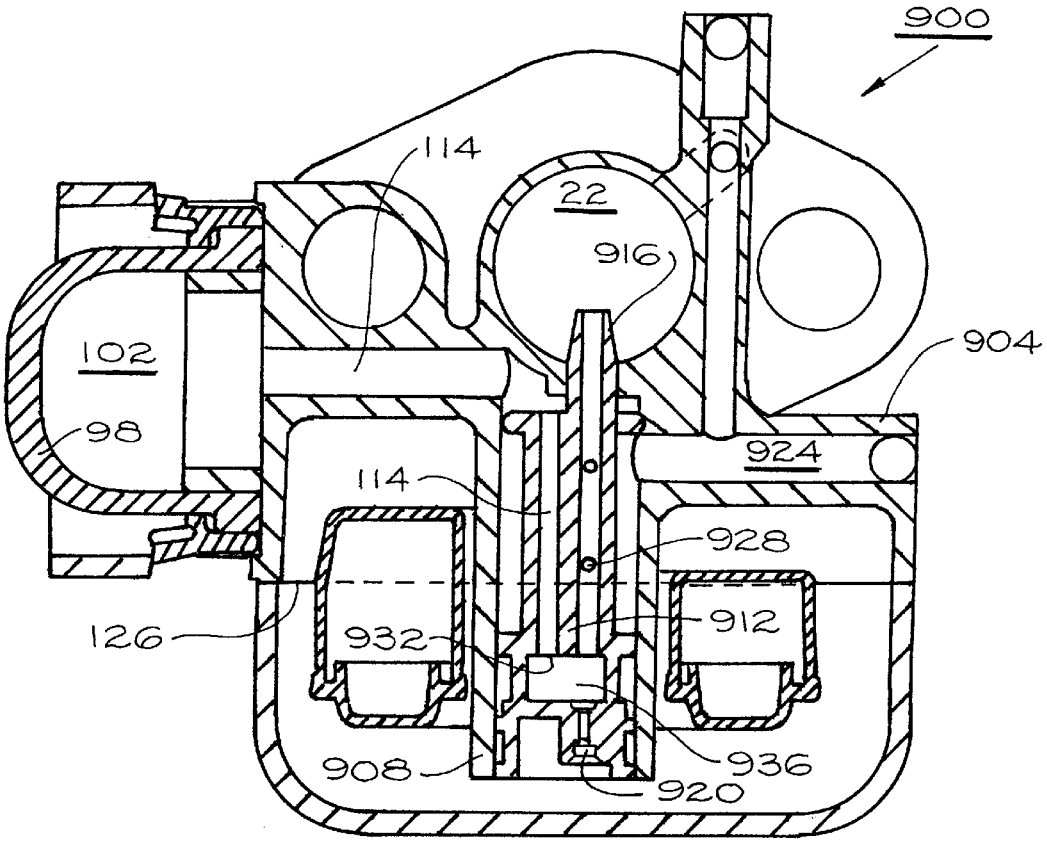
FIG. 9 is a sectional view of another example of a carburetor assembly including the present invention.

FIG. 9 illustrates a ninth carburetor assembly 900 which is similar to carburetor assembly 10. However, the primer bulb 98 is secured to the carburetor body 904 in a slightly different fashion, a fuel bowl nut is not provided and the hollow columnar portion 908 has a different configuration to accept a fuel nozzle assembly 912 which includes a fuel nozzle 916, a fuel jet 920 and a portion of passageway 114. FIG. 9 also illustrates a different well vent 924, as compared to well vent 94 in FIG. 7. Apertures 928 are shown in fuel nozzle 916 to illustrate that the fuel nozzle 916 can communicate with the well vent 924. Although not shown in FIGS. 1–8, the fuel nozzles illustrated therein would also likely include similar apertures. The fuel nozzle assembly 912 is preferably made from a single piece of injected molded plastic. Except for that portion of the passageway 114 which is integrally formed as a part of the fuel nozzle assembly 912, the fuel nozzle assembly 912 is conventional and known to those skilled in the art. Similar to FIG. 1, the passageway 114 allows air to travel from the variable volume chamber 102 when the primer bulb 98 is depressed, out of the second end 932 of the passageway 114 and into the fuel well 936, thereby squirting a quantity of fuel through the end of the fuel nozzle 916 to provide the appropriate priming charge to the carburetor intake passageway 22. Because the end 932 of the passageway 114 opens into the fuel well 936 below the priming fuel level 126 at starting, no significant portion of the displaced pressurized air can escape through the well vent 924. An advantage of the fuel nozzle assembly 912 is that the assembly can be made from an injected molded plastic material to include a portion of the passageway 114 that is normally machined into the carburetor body as is the case, for example, with the carburetor shown in FIG. 1. This type of an arrangement reduces manufacturing and assembly costs.

The foregoing description of the present invention has been presented for purposes of illustration and description. Furthermore, the description is not intended to limit the invention in the form disclosed herein. Consequently, variations and modifications commensurate with the above teachings in skill or knowledge of the relevant art, are within the scope of the present invention. For example, although nine slightly different carburetor assemblies have been illustrated in which the present invention can be employed, the nine different carburetor assemblies, or other carburetor assemblies could be further modified and still incorporate the principles of the present invention and benefit therefrom. The embodiments described herein are further intended to explain the best modes known for practicing the invention and to enable others skilled in the art to utilize the invention as such, or other embodiments and with various modifications required by the particular applications or uses of the present invention. It is intended that the appended claims are to be construed to include alternative embodiments to the extent permitted by the prior art.

Various features of the invention are set forth in the following claims.

What is claimed is:

1. A carburetor for use with an internal combustion engine, the carburetor comprising:

a fuel bowl;

a main fuel jet downstream of the fuel bowl that restricts a flow of fuel from the fuel bowl;

a fuel chamber downstream of the main fuel jet;

a primer bulb having a variable volume chamber; and a passageway having a first end in fluid flow communication with the variable volume chamber and a second end in fluid flow communication with the fuel chamber such that the second end of the passageway is positioned downstream of the main fuel jet and below a starting level of fuel in the fuel chamber.

2. The carburetor according to claim 1, further comprising:

an internal vent that operatively interconnects the fuel chamber with an air intake of the carburetor.

3. The carburetor according to claim 1, further comprising:

a carburetor body having an intake passageway; and a fuel nozzle that operatively interconnects the fuel chamber with the intake passageway.

4. The carburetor according to claim 1, further comprising:

a carburetor body, the fuel bowl being interconnected with the carburetor body; and wherein the primer bulb is also interconnected with the carburetor body.

5. The carburetor according to claim 4, wherein the passageway extends at least partially into the carburetor body.

6. The carburetor according to claim 1, further comprising:

a carburetor body;

a fuel nozzle, disposed in the carburetor body, that operatively interconnects the fuel chamber with an intake passageway of the carburetor, the fuel nozzle having a first end that opens into the intake passageway and a second end that opens into the fuel chamber; and a fuel well chamber between the carburetor body and the fuel nozzle and having a closed lower end.

7. The carburetor according to claim 6, wherein the fuel nozzle includes at least one aperture that opens into the fuel chamber.

8. A carburetor for use with an internal combustion engine, the carburetor comprising:

a carburetor body having an intake passageway;

a fuel bowl interconnected with the carburetor body;

a fuel supply chamber within the fuel bowl, the fuel supply chamber having a fuel level;

a float mechanism within the fuel bowl to regulate the fuel level in the fuel supply chamber;

main fuel jet positioned downstream of the fuel supply chamber such that the main fuel jet regulates passage of fuel from the fuel supply chamber;

a fuel pressurizing chamber downstream of the main fuel jet;

a fuel nozzle that operatively interconnects the fuel pressurizing chamber with the intake passageway;

a primer bulb having a variable volume chamber; and a passageway having a first end in fluid flow communication with the variable volume chamber and a second end in fluid flow communication with the fuel pressurizing chamber, such that the second end of the passageway is positioned downstream of the main fuel jet and below a starting level of fuel in the fuel pressurizing chamber.

9. The carburetor according to claim 8, further comprising:

an internal vent that operatively interconnects the fuel pressurizing chamber with the intake passageway.

* * * * *